United States Patent [19]

Knight

[11] 4,365,237

[45] Dec. 21, 1982

[54] SECURITY AUDIO VISUAL EMERGENCY SYSTEM

[76] Inventor: Webster B. Knight, 3020 Eton Cove, Memphis, Tenn. 38134

[21] Appl. No.: 171,145

[22] Filed: Jul. 22, 1980

[51] Int. Cl.[3] ..... G08B 17/06

[52] U.S. Cl. ..... 340/521; 340/586; 340/596; 340/628; 200/61.03; 343/894

[58] Field of Search ..... 340/521, 517, 545, 546, 340/578, 579, 586, 596, 601, 615, 628, 629, 635, 693; 116/306, 307, 4–6, 75, 77, 67 R, DIG. 38, 44; 307/86; 200/61.03; 343/894, 883, 760; 324/329; 455/226, 351, 348, 349; 250/388

[56] References Cited

U.S. PATENT DOCUMENTS

| | | | |
|---|---|---|---|
| 2,919,353 | 12/1959 | Paradise | 455/351 |
| 3,162,813 | 12/1964 | Piccinini | 455/351 |
| 3,258,757 | 6/1966 | Burdwood | 340/691 |
| 3,769,575 | 10/1973 | Rist et al. | 324/329 |
| 4,090,178 | 5/1978 | Norris | 340/628 |
| 4,093,943 | 6/1978 | Knight | 340/310 R |
| 4,093,943 | 6/1978 | Knight | 340/693 |
| 4,178,592 | 12/1979 | McKee | 340/586 |
| 4,290,057 | 9/1981 | Knight | 340/310 R |

*Primary Examiner*—John W. Caldwell, Sr.
*Assistant Examiner*—Donnie L. Crosland
*Attorney, Agent, or Firm*—Richard T. Seeger

[57] ABSTRACT

A conventional lamp having a tubular yoke around the bulb that supports a lamp shade is converted into a security system by a simple physical electrical and mechanical coupling of two modules, eliminating wiring and installation tools. The first module, referred to as the bulb module, is screwed into the bulb socket and contains line voltage components and supports the light bulb; the second module, the probe module, contains low voltage circuitry, an audio alarm, a pigtail power connector, a light switch, and an extendable sensor probe. Upon sensing an abnormal condition, such as smoke, the bulb flashes on and off and a warning sound is provided by the audio alarm, giving both visual and audio alarm in one self-contained unit.

16 Claims, 3 Drawing Figures

SECURITY AUDIO VISUAL EMERGENCY SYSTEM

RELATED PATENT

Applicant herein is patentee in and owner of U.S. Pat. Nos. 4,093,943 entitled "Sequential Power Distribution Circuit", hereafter "Knight patent", and is applicant in, and owner of, application Ser. No. 945,463 filed Sept. 25, 1978, hereafter "Knite application", and now U.S. Pat. No. 4,290,057 which patent and application are commonly owned with this application and are incorporated herein by reference in the manner as set forth below. The circuits in the foregoing patent and application will be referred to collectively hereinafter as "Knight circuits", and "sequential power distribution circuits".

BACKGROUND OF THE INVENTION

1. Field of the Invention

This invention is in the field of security systems and covers the physical installation and arrangement of two modules that combine electronic circuitry therein, and an extendable sensor probe, with existing building wiring to convert a conventional lamp into a self-contained security warning system with sound and flashing light to provide both audio and visual alarm from a single appliance.

2. Description of the Prior Art

In the art of security detection devices, particularly smoke detectors, it is common practice to put a smoke sensor near the ceiling of a room for earliest detection, and intrusion sensors, particularly the ultrasonic types, are best nearer the ceiling than the floor for greater scanning, sensitivity, and aiming. These sensors are usually housed with related A.C. power supplies and electronic circuitry that either requires A.C. wiring or battery power to provide portability and placement flexibility, and to eliminate costly wiring. But, even more important, is the fact that the smoke sensor must be placed high, while A.C. outlets generally are found low, along the baseboard floor level, and dangling A.C. wiring connecting the two are dangerous and present poor decor. Another disadvantage arises in replacing worn out D.C. batteries. The ultrasonic intrusion sensor often is placed on a table or a bookshelf where crowding inhibits placement and positioning.

There is a need, therefore, to utilize conventional appliances or fixtures already found in the home, and to provide a simple, physical conversion, using no installation tools or wiring, to furnish a security detection system that operates on building line voltage A.C. power with constantly charged D.C. back-up, and provide an extendable probe for sensor aiming and positioning, to give not only audio warning but visual A.C. lighting to see in the dark and flash to alert help. This invention serves that need and converts the ordinary lamp into a self-contained security audio visual emergency system. It is desired in such a system to utilize existing building wiring, to provide adjustable sensor positioning, to utilize the light bulb of the lamp at line voltage as the visual alarm, to provide an audio alarm and to provide D.C. power for back-up power and for power for load or bulb failure alarms, to provide for incorporation of optional state of the art electronic controls such as radio, clock, or weather or emergency alert, and for citizen band reception and transmission.

SUMMARY OF THE INVENTION

The most common house lamp is constructed with a vertical socket for the light bulb, a detachable yoke that is made of oppositely bowed tubular metal uprights that pass up and around the bulb and are welded at the top to the swivel bracket and finial bolt. The shade rest is a circular wire hoop with three or four wire spokes meeting at the center and welded to the shade washer. The shade is attached to the shade rest and positioned on the lamp by slipping the shade washer over the finial bolt and locking it down with the finial hut.

This type of lamp is converted to a lamp of this invention by using two modules. After the light bulb is removed, a bulb module is screwed into the empty light bulb socket and the light bulb is then screwed into a bulb module socket. The modules contain a sequential power distribution series switching circuit providing economy, low component count, and automatic features as load (bulb) and power failure alarms with a constant D.C. battery recharging circuit. The sequential power distribution circuit is as disclosed in the aforementioned Knight patent and application; while parallel circuits can be used, they are not feasible. The bulb module switches line voltage (120 V) to the bulb and provides low voltage to the processing circuits in the second or probe module. The bulb and probe modules contain the Knight circuits.

The probe module is an enclosure approximately six inches long and one inch high. It is shaped like a bow-tie, thinner at the middle, so that heat from the light bulb rises with minimal restrictions at the center of the lamp while components located at the wider ends remain cooler. This shape also minimizes light loss at the central top portion of the shade.

At the bottom center of the probe module is a threaded hole and the entire module is screwed down on the finial thread bolt after the shade has been removed. The module's bow-tie shape greatly facilitates turning and tightening the unit with the fingers. On the top surface of the module is an extendable sensor probe mounted off center of the lamp axis and a second finial bolt is located at the center axis. When the lampshade is replaced, the shade washer will, again, slip over the second bolt and be locked down with the finial nut. Care must be taken to allow the sensor probe to pass vertically up through and between any two spokes of the shade rest.

The probe may be designed to extend a maximum of three feet. For most combinations of table heights and table lamp heights, and for floor lamp heights, the sensor probe on top of the probe module can extend upwardly and position a sensor some six inches beneath an eight foot high ceiling, adequately meeting all sensor position specifications.

After the probe module has been mounted, a pigtail conductor is plugged into the bulb module connecting power between the two modules. The probe module receives low voltage to operate its processing circuits and meets Underwriters Laboratories low voltage requirements.

The lamp is now operational. An on/off switch is located in the probe module and a switch pull cord conveniently hangs below the shade. This eliminates the awkward fumbling and reaching under the shade looking for either a push-pull or turn knob switch on the lamp socket. The conventional lamp switches are always left "on" so that the sensor circuitry receives power even when the light bulb is off.

The probe module contains a battery compartment to house a rechargeable battery. The aforementioned Knight circuits work both on A.C. alone or A.C. with D.C. back up. Also, the battery supplies alarm power when the building power or lamp bulb fails. When the lamp cord is plugged into the A.C. outlet, the battery begins to charge.

The probe module also contains the audio components, such as a radio P.M. speaker or a solid state transducer, to sound an alarm. Sound ports may be located at either end of the probe module for sound regulation; they may also be used for air ventilation of the module itself.

The sensor probe carries at its end a capsule for housing a sensor and LED and also carries electrical wires to the sensor and the LED power indicator light. The probe may be of telescoping design comprised of tubular telescoping sections or otherwise extendable such as a device having plug end sections, folding sections, and the like, the primary purpose being to house circuit wires and physically support the sensor or sensors. The probe may also contain an antenna wire or be made of antenna material to receive a radio signal to operate an optional radio in the probe module or any remote control added to the module. In the same fashion, the probe may be used as a transmitting antenna for a C.B. transmitter or other signal transmission. Further, one or more sensors each for sensing one of a plurality of security breaches may be housed in the capsule.

The above describes the conversion of an existing conventional lamp. For a lamp specifically made or custom built, incorporating the features of this invention, the probe module would be an integral lamp part. The bulb module circuit and line voltage, could be placed in the lamp base, or pedestal, and the light bulb installed in its normal bulb socket. However, low voltage would still be required for the sensor and processing circuits, as defined in the aforementioned Knight circuits. The pigtail conductor carrying the low voltage could be passed through the yoke tubing directly into the probe module and the on/off light switch designed into the lamp base.

Therefore, objects of this invention include providing: a building appliance or light fixture with a security detection alarm system; conversion of a conventional appliance, such as a lamp, to such a system by the simple physical addition of two modules, one module operating at line voltage and the other module operating at low voltage, such conversion requiring no tools or wiring changes; an extendable, aiming probe carrying a security detection sensor at its end, to position the sensor for maximum sensitivity; an audio and visual alarm of a security breach, the visual alarm utilizing a conventional lamp or lighting fixture bulb that is otherwise used for conventional lighting; and an audio alarm for building line voltage failure or for bulb failure. These and other objects and advantages will become more apparent in the following description, aided by the accompanying drawings.

DESCRIPTION OF THE PREFERRED EMBODIMENT

Figure 1:
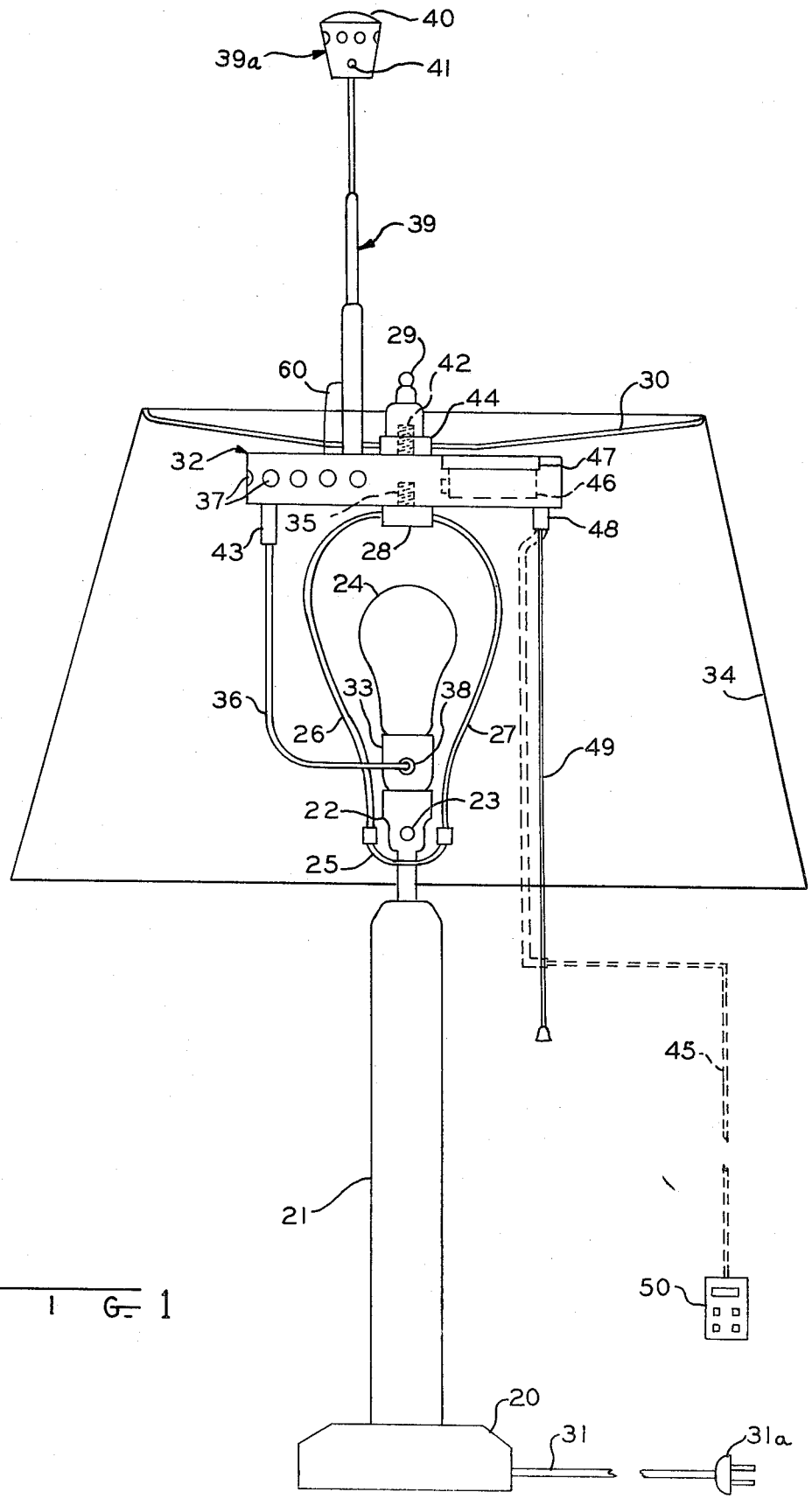
FIG. 1 is a side elevational view, partially sectioned, partially diagrammatic, with an optional feature shown in dashed lines of an embodiment of this invention.

Referring to FIG. 1, a conventional table lamp, as modified by this invention, is shown having a base 20, pedestal 21, and socket 22, with on/off switch 23. A support yoke 25 is made of two pieces of oppositely bowed yoke metal tubing 26 and 27 connecting at their top ends to yoke swivel washer 28 and finial bolt 35. Lamp shade rest 30 is typically a wire hoop having three or four wire spokes meeting centrally at, and welded to, the center shade washer 44. Frame 30 supports lampshade 34. Power cord 31 having plug 31*a* conducts house current at line voltage of 120 V A.C. to the lamp when plug 31*a* is inserted in a conventional wall outlet, not shown.

Converting the ordinary lamp is accomplished by installing two modules, bulb module 33 and probe module 32. Threaded end 33*a* of bulb module 33 is screwed into socket 22 and an ordinary bulb 24 is then screwed into the threaded socket 33*b* in the top of bulb module 33, making contact with the module's internal 120 V A.C. switching circuits as disclosed in the aforementioned Knight circuits.

Probe module 32 is installed by screwing the entire unit onto final bolt 35 and tightly against washer 28. Pigtail conductor 36 is permanently connected to probe module 32. Conductor 36 feeds through sleeve guide 43 for maintaining protective stiffness at module 32 and for directing the pigtail safely outside the confines of tubular yoke members 26 and 27 and away from hot bulb 24. Conductor 36 terminates in plug 38 which is inserted into bulb module 33 completing a power connection between the two modules 32, 33. Bulb module 33 provides low voltage to the probe module 32 through conductor 36.

Lamp shade 34 is carefully placed on the added finial bolt 42, allowing telescoping probe 39 to pass through and between any two spokes of shade rest 30, and shade rest washer 44 slips over finial bolt 42 resting on top of probe module 32. Finial cap nut 29 is screwed on the bolt 42 locking shade 34 on lamp.

Extendable probe 39 carries at its end rotatably mounted capsule 39*a* and is pulled up and extended to a desired height to properly position sensor 40. Sensor 40 is mounted in capsule 39*a* and may be any of heat, fire, smoke, intrusion, or other emergency or security sensors that are commercially available. Probe 39 and/or sensor 40 may be rotated for aiming and to maximize sensitivity. LED (light emitting diode) light indicator 41 is also mounted in capsule 39*a* and shows power is on and sensor 40 is operating.

Figure 2:
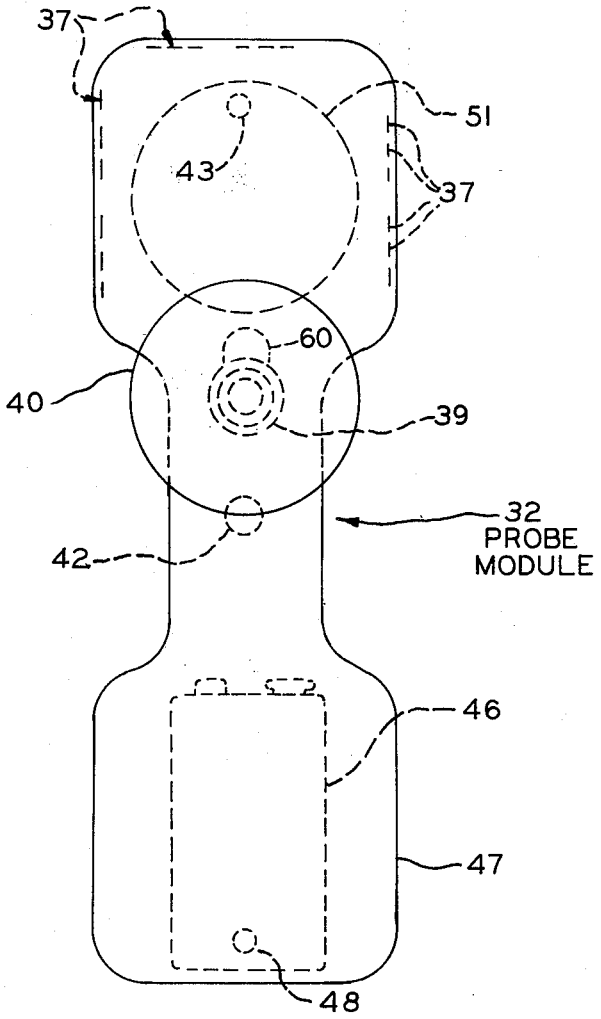
FIG. 2 is an enlarged, top plan view of a first module of this invention used in the embodiment of FIG. 1.
Figure 3:
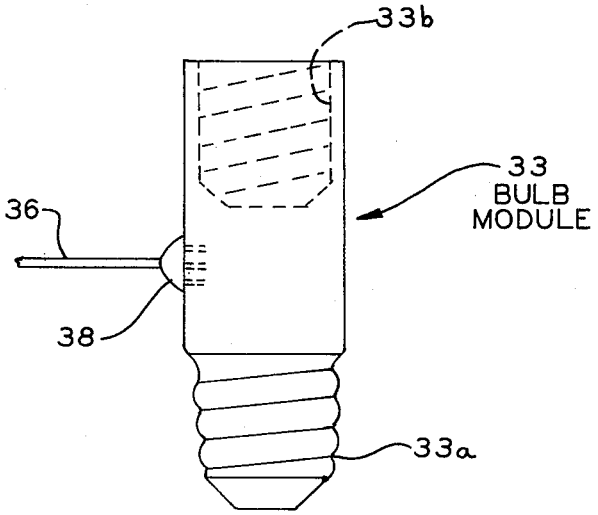
FIG. 3 is an enlarged side elevational view of a second module of this invention used in the embodiment of FIG. 1.

Referring to FIG. 2, probe module 32 has a battery compartment 47 to contain rechargeable battery 46, typically, 9 V NiCd, offering easy access for maintenance and close proximity to logic circuits for operating any optional controls that may be built into the module 32, such as a timer, clock/radio, weather alert, C.B., (citizens band) radio, scanner, etc. Also, the Knight circuits may be incorporated to indicate power failure, load (bulb) failure and provide audio alarms. Audio transducer 51, such as a P.M. speaker, piezoelectric disc, or the like, is housed at one end or probe module 32, FIG. 2, with sound ports 37 provided. Transducer 51 corresponds to alarm 70 in the Knight circuits.

Pull cord 49 (FIG. 1) operates switch 48 in module 32, which may operate the bulb 24 at one half power as disclosed in the Knight circuits. Switch 23 remains on at all times. If switch 23 is turned off, the power failure feature of the Knight circuits will activate an audio alarm, providing a safety feature. FIG. 1 shows cord 49 extending below shade 34, offering convenient switching and eliminating the awkward reaching under the shade and fumbling blindly for the switch.

The following will describe the contents of modules 32, 33, making reference to the circuitry of FIG. 1 of the aforereferenced Knight patent and FIG. 6 of the aforereferenced Knight application.

Module 33 contains triac 54 and resistances 43, 43*a*, and 51, in the Knight circuits, as referenced in the patent and application. Bulb 24 in the instant invention is the primary load 22 in the Knight circuits and plug 31*a* in the instant invention connects to line voltage as represented by AC power source 20 in the Knight circuits.

Module 32, sensor 40, and LED 41 comprise the remaining circuitry in the Knight circuits. Sensor 40 comprises detection circuit 64 in the Knight circuits and LED 41 comprises LED 128 in FIG. 6 of the Knight application. Diode 62 in FIG. 1 of the Knight patent could be replaced by an LED to provide LED 41. The remaining circuitry in FIGS. 1 and 6 of the Knight patent and application, respectively, is in module 32.

The connection points between module 32 and module 33 are made at points A, B, C, in FIGS. 1 and 6 in the Knight patent and application, respectively; connector 26 is a three wire cable to make the necessary connections. The connection points between module 32 and capsule 39*a* are, for the circuit of FIG. 1 of the Knight patent, points 68, 66, and the anode of diode 62, it being understood diode 62, in the Knight patent, has been replaced in this application by LED 41.

The connection points between modules 32, 33 for the circuit of FIG. 6 in the Knight application, are points 61, 68, and the anode of LED 128. A three wire conductor is threaded up probe 39 to make these connections. Pull cord 49 operates switch 46 in the Knight circuits between the off/on positions, the "on" position being when blade 44 is contacting terminal 48. If desired, a three-position rotary switch may be used in module 32 to move blade 44 in the Knight circuits sequentially to terminal 56, to the center "off" position, and to terminal 48, with each pull of cord 49 moving blade 44 sequentially one position. Terminal 56 is for night light 60 in the Knight circuits, and a similar night light 60 may be used in the present invention by conveniently mounting on module 32 and would operate when blade 44 is at terminal 56, as described for the Knight circuits in the Knight patent and application. Battery 46 in the present invention corresponds to battery 124 in the FIG. 6 embodiment of the Knight application.

The probe module 32 offers an easy and simple arrangement for remote control. Pull cord 49 may be replaced with a low voltage, flexible electrical conductor 45, shown in dashed lines, FIG. 1, feeding through sleeve 48, and with ample length, drops down to table top level and connects to modular manually controlled remote control 50. Control 50 contains manually controlled switches, dials, indicators, or the like, and associated circuitry, to control probe module 32 circuit functions, e.g. on/off switch, dimmer, resets, and the like, or optional function modes, e.g. clock, radio, C.B. radio, and the like. The remote control 50 is very light since the power supply for the controlled functions is located in the probe module 32, namely, the constantly charged battery 46, and power is fed through conductor 45, saving weight, space, and providing convenience of operation from chair or bedside.

Probe 39 may also be an antenna to send, as well as receive, signals. Therefore, remote control 50 may be a microphone to activate a transmitter housed in probe module 32 and send broadcasts via the probe 39 antenna for citizen band communication, low-power paging, remote wireless control of appliances, and the like. The probe 39, and sensor 40, and LED 41, and modules 32, 33 may be adapted for use with other appliances such as a kitchen range hood, or the like. Also, module 33 may be used in any building light fixture, such as a ceiling or wall mounted light fixture, and module 32 may be mounted onto the wall or ceiling adjacent the fixture.

Probe 39 may be extendable by motorized means, not shown, controlled by a switch in module 32, or controlled automatically to extend or retract when pull cord 49 is actuated to turn bulb 24 "off" and "on", respectively. Thus, when a room is occupied, and bulb 24 is "on", probe 39 would be automatically retracted to an inconspicuous position, and when bulb 24 is "off", as it would be when the room is unoccupied, probe 39 would automatically be extended to its maximum sensitivity position. A manual override switch may be provided to extend or retract probe 39 regardless of bulb 24 operation. Further, threaded end 33*a* and socket 33*b* in module 33 may be sized to fit any socket thread and bulb thread, respectively, and in any combination of sizes to accommodate any and all bulb and socket size combinations.

The foregoing description of specific apparatus is made by way of example only and not as a limitation of the scope of this invention. In the following claims, the term "sequential power distribution" refers to the aforementioned Knight circuits.

What is claimed is:

1. A lamp for use in a building comprising a base having one end for placement on a building floor or on a supporting surface vertically spaced from the floor;

a first lamp socket being supported by said base;

coupling means for coupling said socket to a building power supply;

a module assembly having a second lamp socket for receiving a lamp bulb and a threaded male end; said male end being threaded into said first lamp socket;

an extensible elongated probe having a first end and a second end being mounted at said first end on said module assembly for vertical extension of said second end;

a sensor for providing a sensing signal upon sensing of at least one of smoke, heat, intrusion or radio wave emergency signal, being attached to said probe second end;

first means for electrically coupling said sensor to said module assembly to provide an electrical path for said sensing signal;

second means provided in said module assembly and responsive to said sensing signal for intermittently flashing a bulb mounted in said second socket upon reception of said sensor sensing signal.

2. The apparatus of claim 1 including a lamp shade support being mounted on and spaced vertically upwardly from said base;

said module assembly comprising first and second modules; said first module being mounted on said lamp shade support and said probe being mounted at said first end to said first module, whereby the height of said lamp shade support is utilized in combination with said probe length to vertically position said probe second end;

said second module having a second lamp socket for receiving a lamp bulb and a threaded male end; said male end being threaded into said first lamp socket;

third means for electrically coupling said first and second modules to one another.

3. The lamp of claim 2 including fourth means being located in said first module and being responsive to said sensing signal to provide an audible alarm upon reception of said sensing signal.

4. The lamp of claim 1 wherein said second means is for providing continuous illumination of a lamp bulb mounted in said second socket during non-reception of a sensing signal.

5. The lamp of claim 4 wherein said second means is for providing a lower intensity level of lamp bulb illumination during non-reception of a sensing signal than during reception of a sensing signal.

6. The lamp of claim 1 including fifth means mounted in said sensor for providing a visual indication that said sensor is operative.

7. The lamp of claim 4 including sixth means affixed to said first module for providing on-off switching of the lamp signal for continuous illumination of a lamp bulb during periods of non-reception of a sensing signal;

said second means providing said intermittent illumination of said lamp bulb during reception of said sensing signal in both on and off switch conditions of the lamp signal of said sixth means.

8. The lamp of claim 7 including seventh means for providing remote control of said sixth means.

9. The lamp of claim 1 wherein said sensor is rotatably mounted relative said module assembly whereby said sensor may be rotated relative said module assembly to improve sensitivity to a sensed condition.

10. The lamp of claim 2 wherein said first module has substantially lower operating voltage and power than said second module.

11. Security detection apparatus comprising sensor means for generating a first signal upon detection of an alarm condition;

sensing circuitry electrically coupled to said sensor means and responsive to said first signal for generating an alarm signal;

alarm means electrically coupled to said sensing circuitry and responsive to said alarm signal for generating an alarm;

lighting means for providing illumination;

support means attached to said lighting means for selectively and adjustably extending and supporting said sensor means to a position remote from said lighting means and for retracting and supporting said sensor means to a position adjacent said lighting means, whereby said sensor means is extendable to maximize sensitivity of the detection apparatus and is retractable to a stored inconspicuous position adjacent the lighting means;

said lighting means comprises a module assembly containing said sensing circuitry and said alarm means;

said support means comprises an extendable probe attached at one end of said lighting means and carrying at its other end said sensor means;

attaching means for attaching said module assembly to a building appliance or fixture device including a lamp appliance or light fixture;

said lighting means comprises a lamp for providing illumination in the building interior, said lamp having a lower end supported relative to a building floor and having a threaded socket for receiving a light bulb and a shade supporting yoke adjacent its upper end, said yoke being at a predetermined height from the building floor; said module assembly comprising first and second modules; said first module adapted for attachment to said lamp yoke; said second module having a threaded end for screwing into the socket of said lamp, and a threaded socket for receiving a light bulb, said extendable probe being attached to said first module, whereby the height of said yoke is utilized in combination with said probe length to vertically position said sensor means;

said modules being electrically coupled to each other by an electrical conductor.

12. The apparatus of claim 11 wherein said sensor means, said sensing circuit, and said alarm circuit comprise a sequential power distribution circuit means supplied with building line voltage power for operating a light bulb mounted in said second module socket during non-alarm conditions to provide continuous illumination, and for operating said bulb intermittently to provide a flashing illumination during alarm conditions to provide a visual alarm.

13. The apparatus of claim 12 wherein said continuous bulb operation will be at reduced power and said flashing bulb illumination will be at increased power.

14. The apparatus of claim 13 wherein said alarm means is for providing an audio alarm during alarm conditions.

15. The apparatus of claim 12 wherein said alarm means is for providing an audio alarm during alarm conditions; said sequential power distribution circuit means including power and bulb failure means for operating said audio alarm upon either line voltage power failure or bulb failure.

16. The apparatus of claim 11 wherein said first module has substantially lower operating voltage and power than said second module.

* * * * *

UNITED STATES PATENT AND TRADEMARK OFFICE

CERTIFICATE OF CORRECTION

PATENT NO. : 4,365,237

DATED : December 21, 1982

INVENTOR(S) : Webster B. Knight

It is certified that error appears in the above—identified patent and that said Letters Patent is hereby corrected as shown below:

Column 1, line 10 for "Knite" read --Knight--;
Column 2, line 12 for "hut" read --nut--;

Signed and Sealed this

*Twenty-fourth* Day of *May 1983*

[SEAL]

*Attest:*

DONALD J. QUIGG

*Attesting Officer*

*Acting Commissioner of Patents and Trademarks*